US006128785A

United States Patent [19]

Sommeregger

[11] Patent Number: 6,128,785

[45] Date of Patent: Oct. 10, 2000

[54] WATERPROOF GLOVE

[75] Inventor: Reinhard Sommeregger, München, Germany

[73] Assignee: W. L. Gore & Associates, Inc., Newark, Del.

[21] Appl. No.: 08/780,862

[22] Filed: Jan. 9, 1997

[51] Int. Cl.[7] ..... A41D 19/00

[52] U.S. Cl. ..... 2/162; 2/159; 2/164

[58] Field of Search ..... 2/16, 158, 159, 2/160, 161.1, 161.6, 162, 164, 167, 168, 170

[56] References Cited

U.S. PATENT DOCUMENTS

| | | | |
|---|---|---|---|
| 699,802 | 5/1902 | Mendelsohn | 2/162 |
| 1,217,307 | 2/1917 | Heise | 2/162 |
| 1,237,180 | 8/1917 | Diddle | 2/162 |
| 2,418,887 | 4/1947 | Jones | 2/162 |
| 2,686,916 | 8/1954 | De Grazia | 2/162 |
| 3,953,566 | 4/1976 | Gore | 264/288 |
| 4,187,390 | 2/1980 | Gore | 174/102 R |
| 4,194,041 | 3/1980 | Gore et al. | 428/315 |
| 4,493,870 | 1/1985 | Vrouenraets et al. | 428/245 |
| 4,725,481 | 2/1988 | Ostapchenko | 428/213 |
| 4,868,927 | 9/1989 | Bourdeau et al. | 2/159 |
| 4,984,299 | 1/1991 | Halldorsdottir | 2/160 |
| 5,073,988 | 12/1991 | Lewis, Jr. et al. | 2/162 |
| 5,125,114 | 6/1992 | Grilliot et al. | 2/162 |
| 5,628,067 | 5/1997 | Meyer et al. | 2/162 |

FOREIGN PATENT DOCUMENTS

| | | | |
|---|---|---|---|
| 142691 | 8/1951 | Australia | 2/162 |
| 0683989 | 5/1994 | European Pat. Off. . | |
| 357630 | 1/1906 | France | 2/162 |
| 591433 | 4/1925 | France | 2/162 |
| 7819843 | 6/1979 | Germany . | |
| 3820100 | 12/1989 | Germany . | |

*Primary Examiner*—Amy B. Vanatta
*Attorney, Agent, or Firm*—Gary A. Samuels

[57] ABSTRACT

A waterproof glove with a shaft incorporating a hand insertion opening and a shaft edge located at the hand insertion opening side and consisting of a shell material. A waterproof cuff sleeve with a lower cuff edge is arranged inside of the shaft such that it lies below the shaft edge by a predetermined underlength and is connected with the shaft edge and with an upper cuff edge that projects over the shaft edge by a predetermined overlength. A sleeve accomodation groove is formed between the shaft and the sleeve cuff so that a lower end area of a wearer's garment sleeve can be inserted into the sleeve accomodation groove. A groove base formed in the lower cuff edge is sealed so that water from the sleeve accomodation groove cannot reach the interior of the glove. The overlength of the cuff sleeve is dimensioned such that when the wearer holds the hand in such a position that water can accumulate in the sleeve groove, water from the sleeve groove cannot reach the upper edge of the cuff.

26 Claims, 7 Drawing Sheets

WATERPROOF GLOVE

FIELD OF THE INVENTION

The present invention relates to a waterproof glove, more specifically, to a waterproof glove that prevents ingress of water into the glove.

BACKGROUND OF THE INVENTION

Waterproof gloves are used for a variety of purposes such as skiing or motorcycling. It has become state of the art for some time now to make gloves windproof and at the same time breathable by using a water and air permeable material, e.g. leather or a textile material, as the outer shell material and by providing a functional layer consisting of a waterproof, yet water vapour permeable material, e.g. microporous polytetrafluoroethylene (PTFE), on the inner side of the shell material. According to present common practice, the functional layer is either in the form of a so-called insert, i.e. a glove-like inner component, and is loosely mounted on the inside of the glove shell material such that the insert is not pierced by sewing seams in the shell material, or the glove is made from a laminate comprising an outer material layer and a functional layer and the seams of the glove which go through the functional layer are sealed by a waterproof seam sealing tape on the inside of the functional layer. Such gloves remain breathable despite their waterproofness so that perspiration moisture forming inside the glove can escape through the functional layer and the shell material.

A glove may be waterproof because its shell material is waterproof. Alternatively, such a glove can also be rendered waterproof by a state of the art construction wherein the shell material is air-permeable and water permeable and another layer is arranged on the back side of the shell material which consists of a waterproof material and which preferably is a waterproof, yet water vapour permeable functional layer. Materials suitable for the functional layer comprise PTFE as described in U.S. Pat. Nos. 3,953,566 and 4,187,390; expanded PTFE provided with hydrophilic impregnating agents and/or layers as described in U.S. Pat. No. 4,194,041; breathable polyurethane layers; or elastomers, such as copolyetherester and laminates thereof, as described in U.S. Pat. Nos. 4,725,481 and 4,493,870.

Presently existing waterproof gloves are usually worn together with coat or jacket like garments whose sleeve ends project over the shaft edge of the gloves such that the area of the glove shaft with the hand insertion side end and the area of the sleeve end facing the hand overlap. The area of the sleeve overlapping with the shaft end may either be worn outside of the glove or inside the glove. Both configurations entail the shortcoming that water in the form of rain or snow can get inside the glove. If such a glove is worn by a motorcyclist, for example, one can proceed upon the assumption that the hand wearing the glove is in an angular position somewhere in between a horizontally extended and a vertically hanging hand. If water falls onto the sleeve and glove, in particular rain water or water whirled into the air from the road by vehicles ahead, the headwind drives this water along the outside of the shaft upwards towards the shaft end. When the motorcyclist is standing still, e.g. at red traffic lights, the water will run down the outside of the sleeve and the shaft. If the sleeve is worn outside of the shaft, the water runs off without running into the glove, as long as the motorcyclist is at a standstill, but otherwise it is driven between the inside of the sleeve and the outside of the shaft over the shaft end or the shaft edge from where it can reach the interior of the glove. If the sleeve is worn inside of the shaft of the glove, water runs between the outside of the sleeve and the inside of the shaft while the motorcyclist is standing and, again, reaches the interior of the glove.

SUMMARY OF THE INVENTION

The waterproof glove of the present invention is provided with a shaft of a shell material having a hand insertion opening side with a shaft edge located at the side of the hand insertion opening. A waterproof cuff sleeve with lower and upper cuff edges is arranged such that the lower cuff edge is inside the shaft below the shaft edge by a predetermined underlength and is connected to the shaft edge. The upper cuff edge projects over the shaft edge by a certain predetermined overlength. A sleeve accomodation groove is formed between the shaft and the cuff sleeve to accomodate the lower end of a garment sleeve worn by the wearer. A groove base is formed in the area of the lower cuff edge is sealed to prevent ingress of water into the glove by the sleeve accomodation groove. The overlength of the cuff sleeve is dimensioned such that when the glove is positoned such that water accumulates in the sleeve groove, this water cannot reach the upper cuff edge.

It is a purpose of the present invention to provide an improved waterproof glove.

A purpose of the present invention is to provide a groove for water to accumulate without flowing into the interior of the glove.

It is another purpose of the invention to provide a glove that is a barrier to microorganisms.

Yet another purpose is a glove that provides a barrier to noxious gases, chemical agents, or microorganisms.

Another purpose of the present invention is to provide a groove for a wearer's sleeve.

A purpose of the present invention is to provide a lining layer on the interior of the glove to provide added protection for the wearer.

Further purposes, embodiments and constructions of the glove are included in the detailed description of the invention.

DETAILED DESCRIPTION OF THE INVENTION

Figure 1:
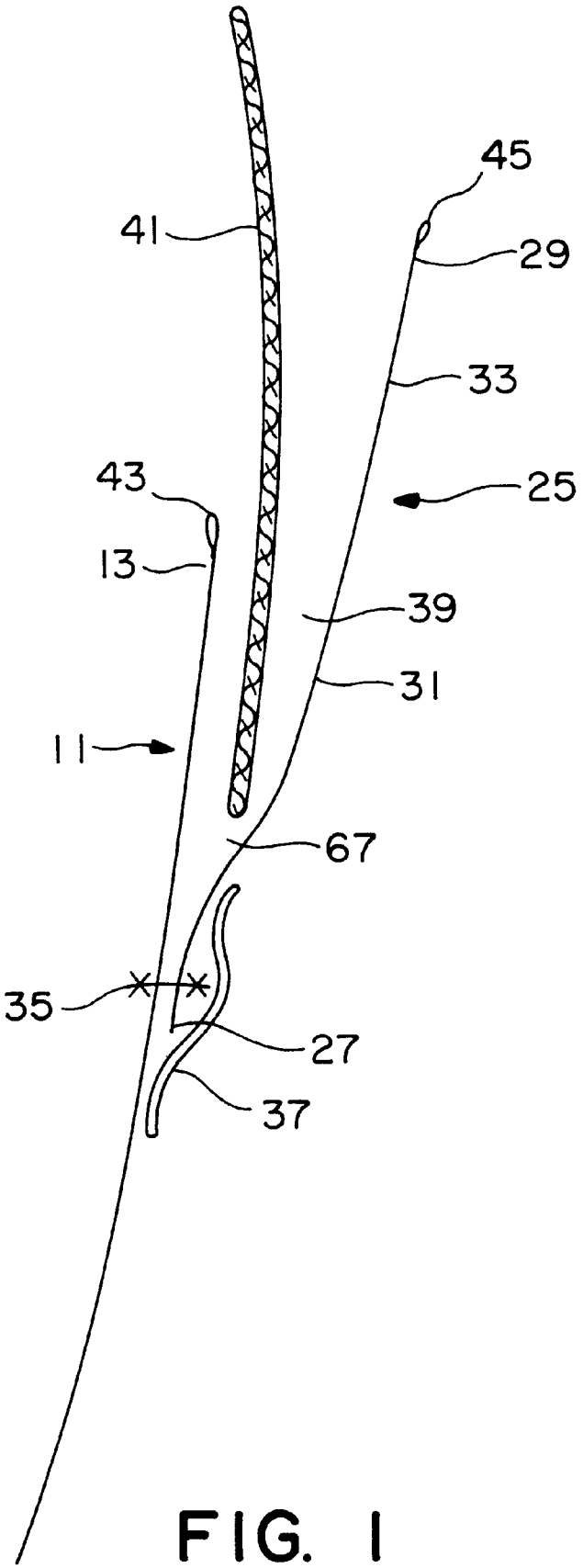
FIG. 1 is a schematic partial view of a glove in which the shaft and cuff sleeve are attached by a sewn seam and covered with seam sealing tape.

In the embodiment shown in FIG. 1 the glove and thus also the shaft 11 consist of a laminate which comprises a shell material on the outside of the shaft 11, a functional layer on its inside, and optionally also a lining layer behind the functional layer. A cuff sleeve 25 is arranged on the inside of the shaft 11. The cuff sleeve 25 comprises a lower cuff edge 27 located within the shaft and an upper cuff edge 29 projecting over the shaft edge 13. The cuff sleeve 25 consists of a waterproof material, preferably in the form of a waterproof, water vapour permeable functional layer. This layer can also be a barrier to penetration by noxious gases, chemical agents, or microorganisms depending on the end use. Seen from the shaft edge 13, the lower cuff edge 27 lies underneath the shaft edge 13 by a predetermined underlength 31 and the upper cuff edge 29 projects over the shaft edge 13 by an overlength 33. The lower cuff edge 27 is attached to the shaft 11 by a sewing seam 35 in the lower edge. Seam 35 is located below the shaft edge 13 as determined by the underlength 31. The seam 35 in the lower edge is waterproofly sealed by a waterproof seam sealing tape 37 on the inside of the cuff sleeve 25 that prevents water from migrating along the lower edge seam into the glove at the seam in the lower edge. The side of the seam sealing tape 37 facing the shaft 11 sticks so firmly to the shaft laminate that the seam sealing tape 37 forms a waterproof construction up to the surface of the functional layer, even if a protective textile layer is provided on the functional layer for mechanical reinforcement.

Whenever terms like "upper" and "lower" are used in connection with the glove of the invention, this always refers to a position in which the glove's finger area faces downwards and the shaft end with the hand insertion side faces upwards. If a glove were to be described in a different position, these terms would have to be transformed accordingly. In other words, the terms "upper" and "lower" are defined to also encompass such transformed descriptions in the framework of this patent application.

A sleeve accomodation groove 39 is formed between the part of the shaft 11 located between the shaft edge 13 and the sewing seam 35 in the lower edge and the cuff sleeve 25. The lower end of a wearer's sleeve 41 schematically shown in FIG. 1 can be accomodated by this groove 39. The shaft edge 13 and the upper cuff edge 29 are each provided with an elastic 43/45, respectively, so that both the upper cuff edge 29 and the shaft edge 13 and the sleeve 41 located in the sleeve accomodation groove 39 are held tightly on the wearer's arm. However, the elastic 43 cannot prevent water running down the sleeve 41 from flowing into the sleeve accomodation groove 39. This water cannot get inside of the glove because in the position in which the glove wearer usually holds the arm the water can rise only up to the shaft edge 13 and can run off over the shaft edge 13 if further water comes in. If the overlength 33 of the cuff sleeve 25 is suitably selected, water can be prevented from reaching over the upper cuff edge 29 by migrating along the cuff sleeve 25, as already described above.

For example, when a motorcyclist uses such a glove, both water which falls onto the sleeve 41 while the motorcyclist is standing still and runs down the sleeve and water which had been driven by headwind over the shaft edge 13 during driving and runs back along the sleeve again during standstill flows into the sleeve accomodation groove 39. Since the upper cuff edge 29 located inside of the sleeve 41 extends over the shaft edge 13 by its overlength 33 and since the sleeve accomodation groove 39 can fill with water only up to the level of the shaft edge when the hand is in the usual motorcycling position, excess water will run out of the full sleeve accomodation groove via the shaft edge and not via the upper cuff edge. The only thing which might happen is that part of the water creeps up to the upper cuff edge 29 by a wicking effect. This can be easily avoided by using a material which has little to no water wicking capacity.

It is enough to prevent water entering the sleeve accomodation groove 39 from flowing or creeping up to the upper cuff edge 29 if the cuff sleeve 25 has an overlength 33 of about 5 to 10 cm over the hand insertion side shaft edge 13, i.e. the upper cuff edge 29 projects upwards by about 5 to 10 cm when the glove fingers are held vertically downwards.

The overlength 33 selected in each case can be adapted to the material selected for the cuff sleeve 25 and the glove size. If the cuff sleeve 25 has a relatively high absorption capacity on its outside, a larger overlength 33 will be advisable. If the absorption capacity is low, a smaller overlength 33 will do. In a concrete embodiment of a men's glove wherein the cuff sleeve 25 consists of a laminate with a functional layer of microporous PTFE and a textile layer on its outside, an overlength 33 of about 9 cm was selected for the cuff sleeve.

Figure 2:
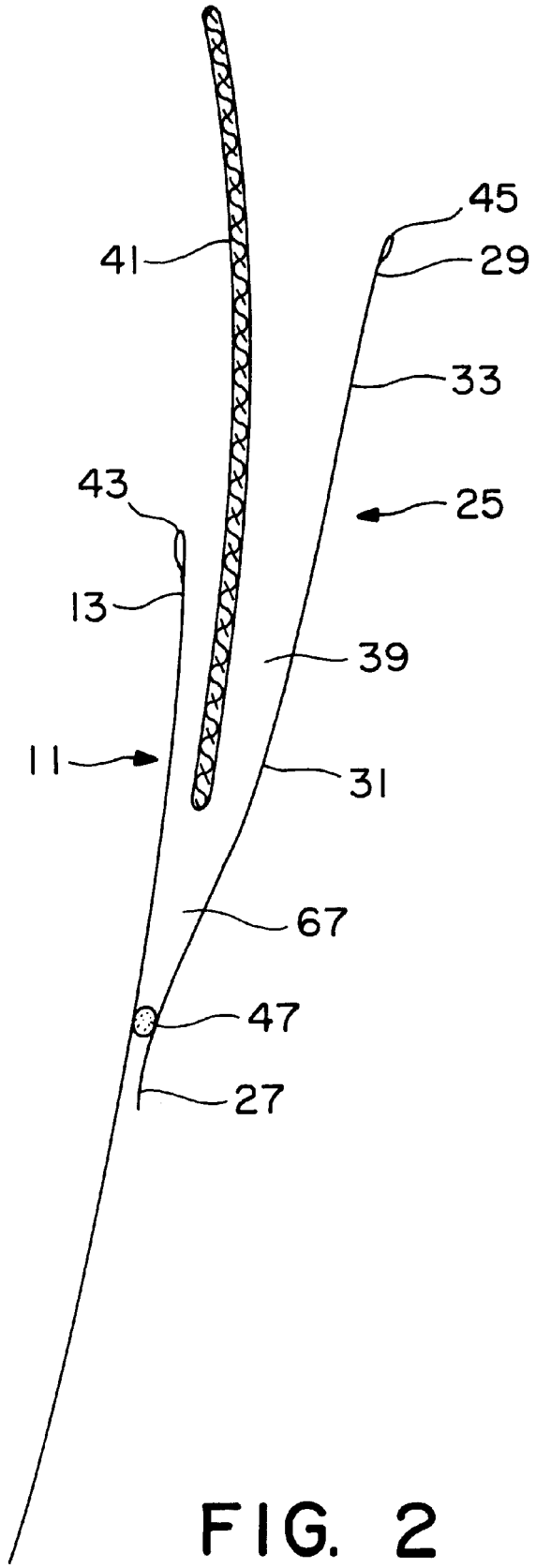
FIG. 2 is a schematic partial view in which the shaft and cuff sleeve are attached by an adhesive seam.

The embodiment shown in FIG. 2 is very similar to the one shown in FIG. 1. The only difference is that instead of the sewing seam 35 in the lower cuff edge 27, an adhesive seam 47 is formed by means of a waterproof adhesive provided in the lower cuff edge.

In the two embodiments shown in FIGS. 1 and 2, the cuff sleeve 25 may be made from the same material as the shaft 11 or from a different material which consists of a functional layer or incorporates a functional layer.

Figure 3:
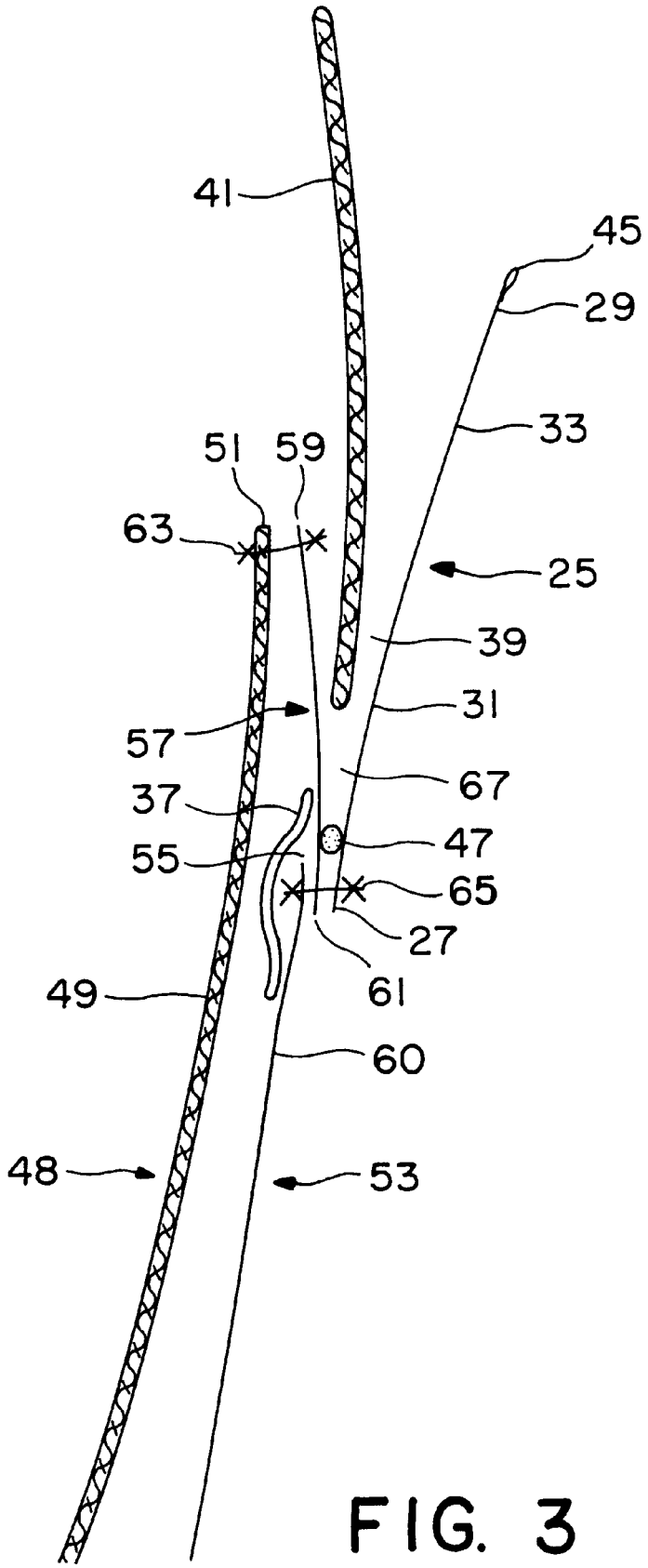
FIG. 3 is a schematic partial view of the intermediate sleeve connected by a sewn seam between the inner shaft and cuff sleeve by a sewing seam.
Figure 4:
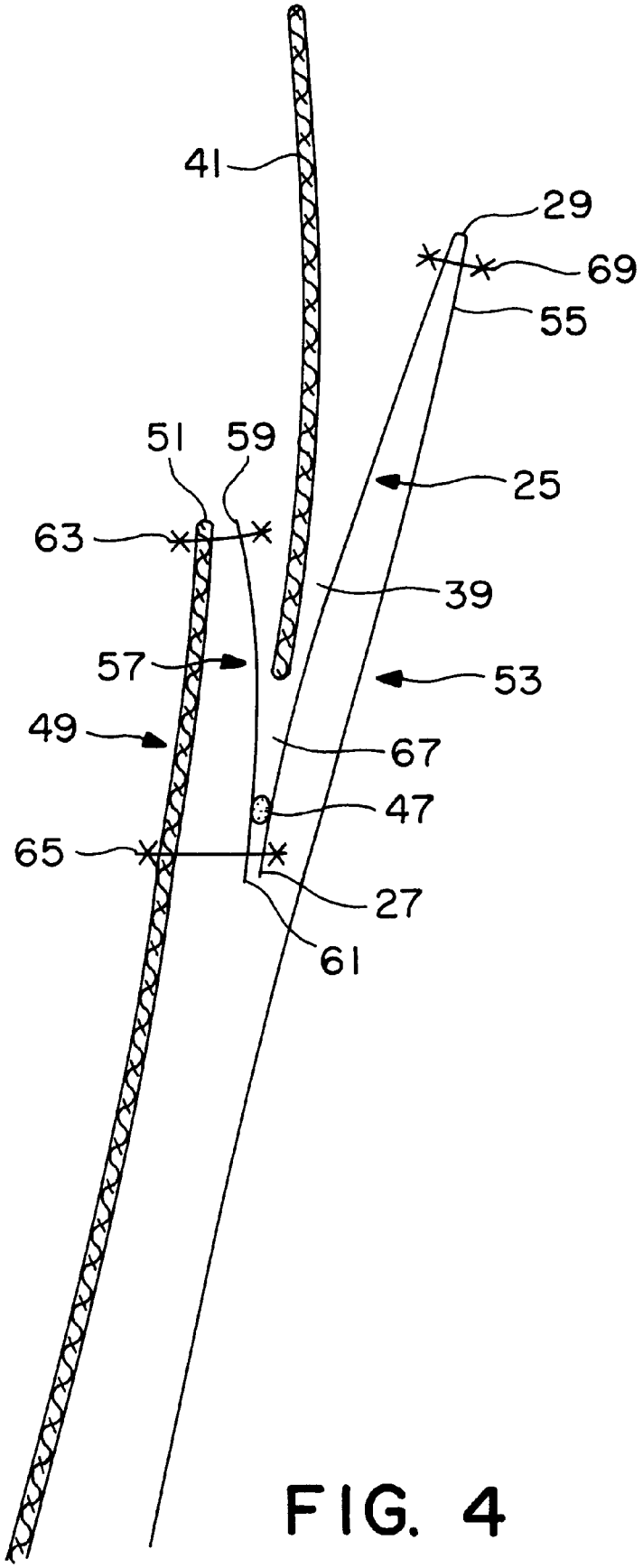
FIG. 4 is a schematic partial view of the inner glove attached to the upper cuff edge.

FIGS. 3 and 4 show embodiments with an outer glove 48 consisting of an outer material and in inner glove 53 consisting of a functional layer. In FIG. 3, the outer glove 48 is provided with an outer shaft 49 on the hand insertion side end of which there is an outer shaft edge 51. The inner glove 53 is provided with an inner shaft 60 with an inner shaft edge 55 at the hand insertion side end. In this embodiment the lower cuff edge 27 is connected to the outer shaft edge 51 not directly but via an intermediate sleeve 57 consisting of a waterproof material. This intermediate sleeve 57 comprises an upper edge 59 and a lower edge 61. The upper edge 59 of the intermediate sleeve is connected to the outer shaft edge 51 by means of a sewing seam 63 in the upper edge of the intermediate sleeve. The lower edge 61 of the intermediate sleeve is connected both to the lower cuff edge 27 and to the inner shaft edge 55 by means of a sewing seam 65 in the lower edge of the intermediate sleeve. The base of the groove 67 is sealed by an adhesive seam 47 above the sewing seam 65 in the lower edge of the intermediate sleeve to prevent water in the sleeve accomodation groove 39 from reaching the inside of the glove through the sewing seam 65 in the lower edge of the intermediate sleeve. Furthermore, the sewing seam 65 in the lower edge of the intermediate sleeve is waterproofly sealed by a seam sealing tape 37 on the side facing the outer shaft 49 to prevent water which reaches the outside of the sewing seam 65 in the lower edge of the intermediate sleeve from getting into the glove through the outer shaft.

In this embodiment the inner glove consists of a laminate which works as a functional layer and also as a lining layer on the side facing the interior of the glove.

The cuff sleeve 25 and the intermediate sleeve 57 may both consist of the same material as the inner glove 53 or of a different material which forms or incorporates a functional layer.

FIG. 4 shows an embodiment which is very similar to the one shown in FIG. 3 except the inner shaft edge 55 is not attached to the sewing seam 65 in the lower edge 61 of the intermediate sleeve, but to the upper cuff edge 29. The sewing seam 65 in the lower edge 61 of the intermediate sleeve also goes through the outer shaft 49 so that the groove base 67 of the sleeve accomodation groove 39 is held stationary on the outer shaft 49. This prevents the intermediate sleeve 57 and the sleeve accomodation groove 39 from being pulled out of the glove.

Also in this embodiment, the inner glove 53 consists of a laminate which has both a functional layer and a lining layer. If the cuff sleeve 25 consists of the same material as the inner glove 53, the cuff sleeve 25 and the inner glove 53 can be constructed as one piece with a folded part in the area of the upper cuff edge 29 and the inner shaft edge 55. If additionally the intermediate sleeve 57 consists of this material, these three parts, namely the intermediate sleeve 57, the cuff sleeve 25 and the inner glove 53 can be constructed as one piece. In this case there is also a folded part of this one-piece element in the area of the lower edge 61 of the intermediate sleeve and the lower cuff edge 27 (not shown in FIG. 4). To keep this one-piece part in the shape shown in FIG. 4, the sewing seam 65 in the lower edge of the intermediate sleeve and a sewing seam 69 in the upper edge of the cuff are preferably provided despite the one-piece construction.

Figure 5:
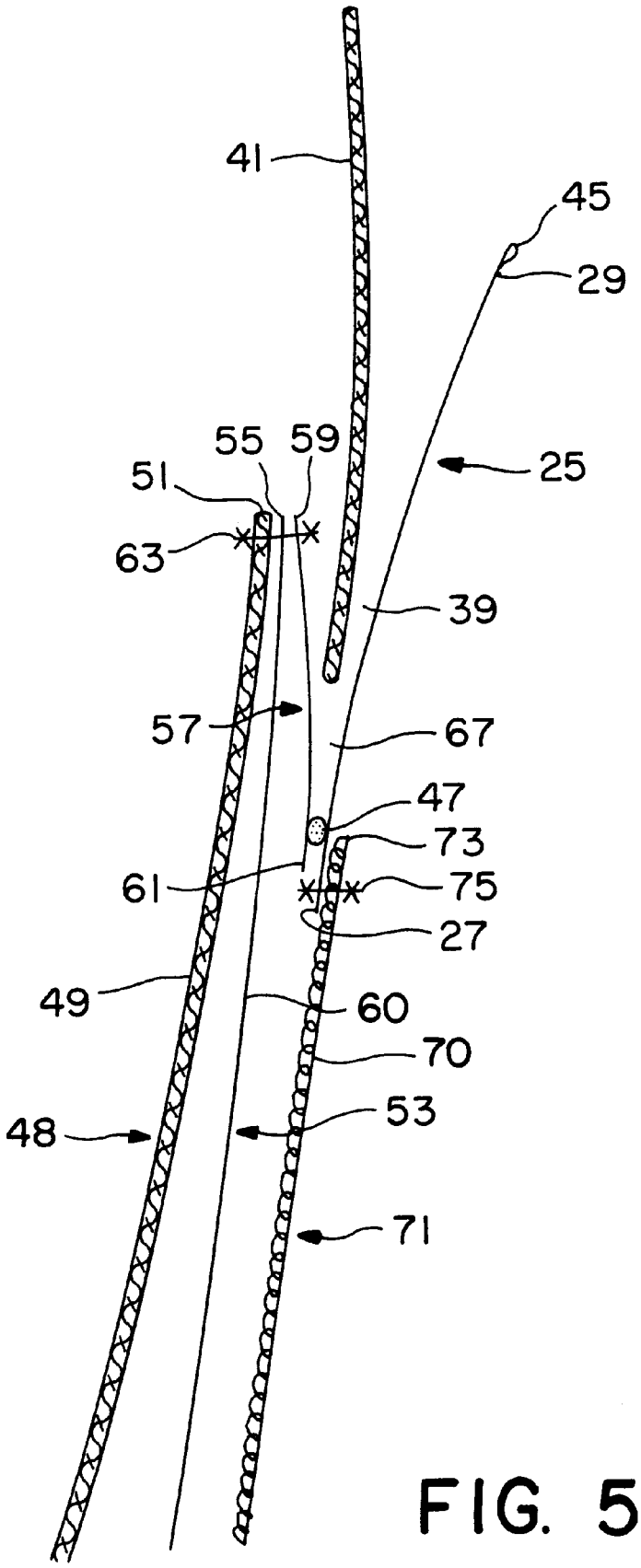
FIG. 5 is a schematic partial view of the lining glove in which the inner glove connects at the outer shaft edge.
Figure 6:
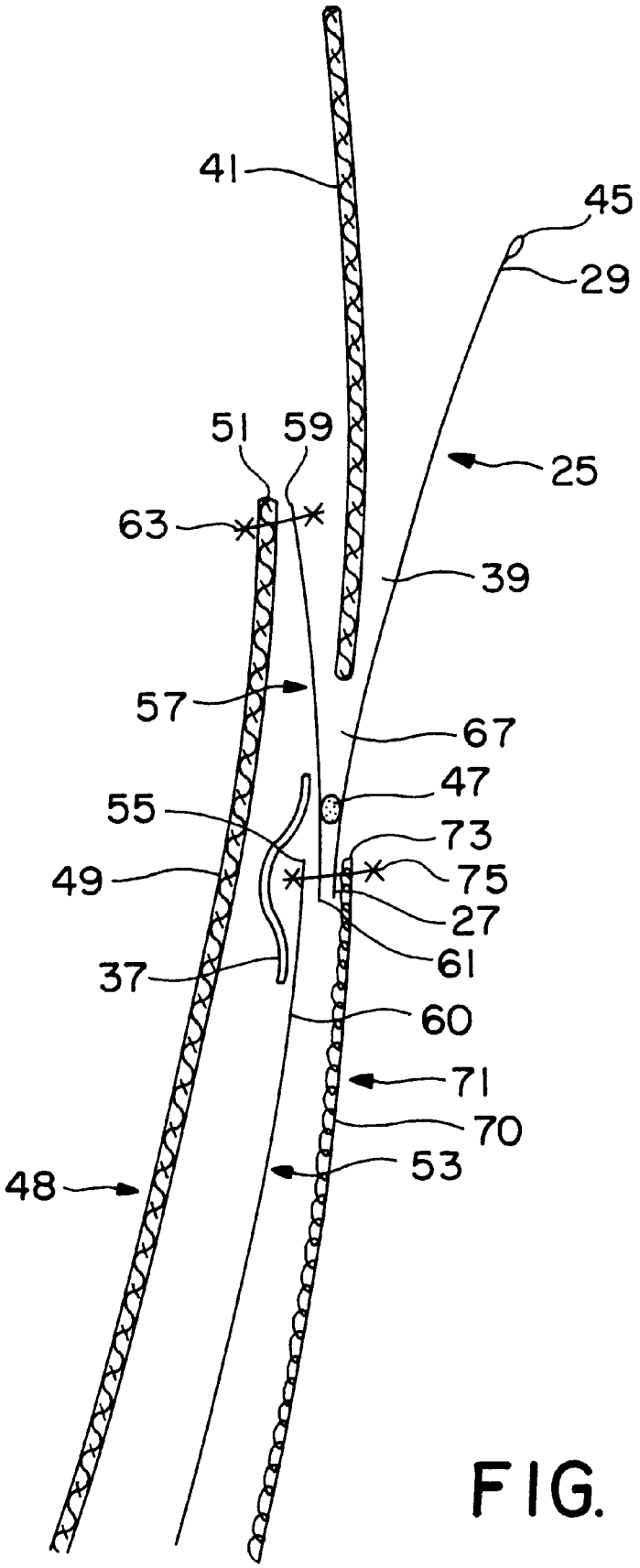
FIG. 6 is a schematic partial view of the inner glove attached to the intermediate sleeve, lower cuff edge and lining shaft edge.

FIGS. 5 and 6 are provided with an outer glove 48 consisting of an air and water permeable shell material and comprising an outer shaft 49 and an outer shaft edge 51 on the outside, an inner glove 53 consisting of a functional layer and comprising an inner shaft 60 and an inner shaft edge 55 located inside of the outer glove 48 and a lining glove 71 as the innermost element consisting of a lining material and comprising a lining shaft 70 and a lining edge 73. In both cases, there is a cuff sleeve 25 with a lower cuff edge 27 and an upper cuff edge 29 and an intermediate sleeve 57 with an intermediate sleeve upper edge 59 and an intermediate sleeve lower edge 61.

In the embodiment shown in FIG. 5, the inner shaft edge 55 and the upper edge 59 of the intermediate sleeve are attached to each other by means of a sewing seam 63 in the upper edge of the intermediate sleeve. The groove base 67 of the sleeve accomodation groove 39 is sealed against leakage of water from the sleeve accomodation groove into the glove by means of an adhesive seam 47 on the lower edge.

The lining shaft edge 73 is attached to the lower cuff edge 27 by means of a sewing seam 75 in the lower cuff edge.

In FIG. 5, the inner glove 53 consists of a waterproof material which comprises a functional layer but no lining. The cuff sleeve 25 and the intermediate sleeve 57 may consist of the same material or of a different material with a functional layer. If the inner glove 53, the intermediate sleeve 57 and the cuff sleeve 25 consist of the same material, this embodiment can be modified such that all three elements are constructed in one-piece and connected with each other at the transitions by folded areas. The latter may be held stationary by sewn seams and/or adhesive seams.

The embodiment shown in FIG. 6 deviates from the one shown in FIG. 5 in that the inner shaft edge 55 does not reach up to the outer shaft edge 51 but only up to a sewing seam 75 in the lower cuff edge 27 by means of which the lower cuff edge, the lower edge 61 of the intermediate sleeve, the inner shaft edge 55 and the lining shaft edge 73 are attached to each other. Here, too, the groove base 67 is sealed by an adhesive seam 47 in the lower edge.

The outside of the sewing seam 75 in the lower cuff edge 27 is sealed by means of a sealing tape 37 which makes it waterproof so that water penetrating the water permeable material of the outer shaft 49 cannot reach the inside of the glove through the seam 75 in the lower cuff edge.

In the embodiments shown in FIGS. 3 to 6, which have an intermediate sleeve 57, the intermediate sleeve and the cuff sleeve 25 may be constructed as one piece provided they consist of the same waterproof material. In this case, the lower cuff edge 27 and the lower edge 61 of the intermediate sleeve are connected with each other by folding this one-piece material. Said folded area may be held stationary, e.g. by an adhesive seam.

In deviation to FIGS. 5 and 6, the lining shaft edge 73 may also be attached to the upper cuff edge 29 (not shown).

In one embodiment, the invention provides for a protective waterproof, water vapor permeable material that absorbs, adsorbs, detoxifies, or chemically reacts with noxious gases or chemical agents to act as a barrier.

Another specific embodiment of the present invention provides for a protective cover suitable for use in environments where contact with microorganism is to be avoided. This barrier remains waterproof and water vapor permeable.

Figure 8:
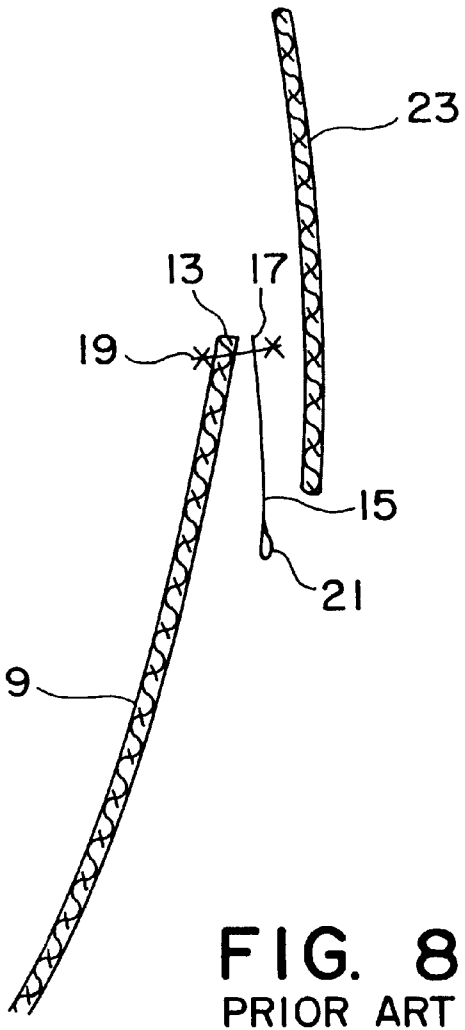
FIG. 8 PRIOR ART
FIG. 8 is a schematic partial view of presently existing gloves with the sleeve on the interior.
Figure 7:
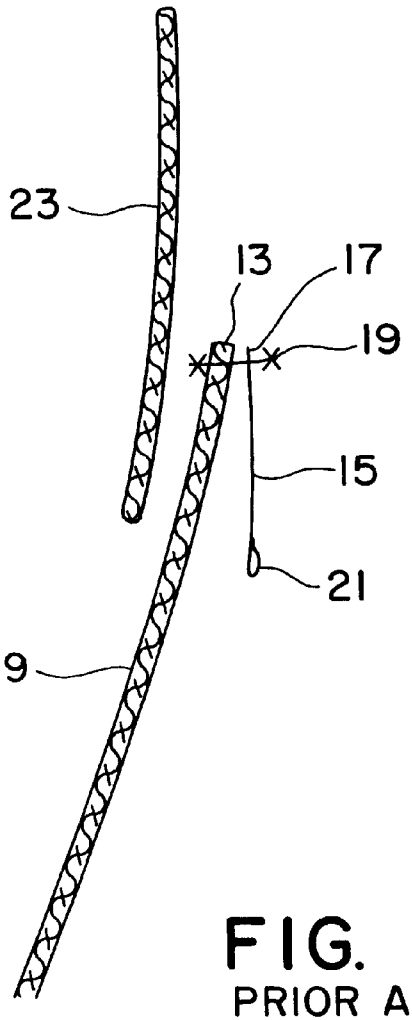
FIG. 7 PRIOR ART
FIG. 7 is a schematic partial view of presently existing gloves with the sleeve on the exterior.

FIGS. 7 and 8 illustrate presently existing gloves. The glove consists of a laminate 9 which has a water permeable and air permeable outer layer and a waterproof, water-vapour permeable functional layer on its inside. Usually an inner textile layer, which may be a lining layer, is arranged behind the inside of the functional layer. A tube-shaped finishing sleeve 15 is located in the area of the hand-insertion side end within the area of the shaft edge 13. The upper end of the tube-like finishing sleeve 17 at the hand insertion side is mounted to the shaft edge 13 by a sewing seam 19. The lower end the finishing sleeve 15 is provided with an elastic 21 so that the lower end of the finishing sleeve 15 alway lies tightly on the glove wearer'sunder arm area. The wearer's sleeve 23 is shown on the gloves exterior (FIG. 7) and interior (FIG. 8).

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

We claim:

1. A waterproof glove comprising:

(a) a shaft of a shell material having a hand insertion opening side with a shaft edge on the hand insertion opening side;

(b) a waterproof cuff sleeve arranged inside of the shaft with a lower cuff edge and an upper cuff edge, said lower cuff edge being arranged inside of the shaft below the shaft edge by a predetermined underlength and connected to the shaft, the upper cuff edge projects over the shaft edge by a predetermined overlength;

(c) a sleeve accomodation groove formed between the shaft and the cuff sleeve to accomodate the lower end of a wearer's garment sleeve;

(d) a groove base formed in the area of the lower cuff edge sealed to prevent ingress of water into the glove via the sleeve accomodation groove; and (e) the overlength of the cuff sleeve is dimensioned such that when the glove is held in a position such that water accumulates in the sleeve accomodation groove, the water cannot reach the upper cuff edge.

2. The glove of claim 1, wherein the shell material consists of a waterproof material.

3. The glove of claim 2, wherein the lower cuff edge is connected directly to the shaft underneath the shaft edge.

4. The glove of claim 3, wherein the lower cuff edge is attached to the shaft by a sewn seam that is sealed on the interior cuff sleeve by a waterproof seam sealing tape.

5. The glove of claim 3, wherein the lower cuff edge is adhesively bonded to the shaft by a waterproof adhesive seam.

6. The glove of claim 2, wherein the shell material is provided with an interior lining layer.

7. The glove of claim 2, wherein a lining glove is arranged inside of the shell material.

8. The glove of claim 7, wherein a hand-insertion side shaft edge of the lining glove is connected to the upper cuff edge.

9. The glove of claim 7, wherein a hand insertion side shaft edge of the lining glove is connected to the lower cuff edge underneath the adhesive seam.

10. The glove of claim 2, wherein the waterproof material consists of a waterproof and water vapor permeable functional layer.

11. The glove of claim 10, wherein the functional layer is formed by microporous PTFE.

12. The glove of claim 2, wherein the waterproof material is a barrier to microorganisms.

13. The glove of claim 12, wherein the waterproof material is water vapor permeable.

14. The glove of claim 2, wherein the waterproof material is a barrier for absorbing noxious gases or chemical agents.

15. The glove of claim 14, wherein the waterproof material is water vapor permeable.

16. A waterproof glove comprising:

(a) an outer glove of a shell material permeable to water having an outer shaft and an outer shaft edge;

(b) an inner glove arranged inside of the outer glove having an inner shaft and an inner shaft upper edge located at a hand insertion side;

(c) a waterproof cuff sleeve with a lower cuff edge and an upper cuff edge, said lower cuff edge being arranged inside of the outer glove below the outer shaft edge by a predetermined underlength, the upper cuff edge projects over the outer shaft edge by a predetermined overlength;

(d) an intermediate sleeve having an upper and lower edge arranged between the outer shaft and cuff sleeve, the intermediate sleeve upper edge connected to the outer shaft edge and the intermediate sleeve lower edge located under the outer shaft edge inside of the outer shaft and connected to the lower cuff edge; and (e) the intermediate sleeve and inner glove are of a waterproof material.

17. The glove of claim 16, wherein the inner shaft edge located at the hand insertion side is arranged between the outer glove and the intermediate sleeve and is attached to the outer shaft edge together with the upper edge of the intermediate sleeve.

18. The glove of claim 16, wherein the inner shaft edge located at the hand insertion side is connected to the cuff upper edge whereby the cuff sleeve and the intermediate sleeve are arranged between the outer shaft and the inner shaft.

19. The glove of claim 16, wherein the inner shaft edge located at the hand insertion side is connected with the lower edge of the intermediate sleeve.

20. The glove of claim 19, wherein the inner shaft edge and the lower edge of the intermediate sleeve are connected with each other by means of a sewing seam which is sealed on the outside facing the outer shaft by means of a waterproof seam sealing tape.

21. The glove of claim 16, wherein the inside of the waterproof material of the inner glove is provided with a lining layer.

22. The glove of claim 16, wherein a lining glove is arranged inside of the inner glove.

23. The glove of claim 22, wherein a lining shaft edge on the hand-insertion side is connected to the lower cuff edge.

24. The glove of claim 23, wherein the lower cuff edge and the lower edge of the intermediate sleeve are connected with each other by a waterproof adhesive seam.

25. The glove of claim 23, wherein the edge of the lining shaft is connected with the lower cuff edge by means of a sewing seam located below the adhesive seam.

26. The glove of claim 25, wherein both the inner shaft edge and the lining shaft edge and the lower cuff edge and/or the lower edge of the intermediate sleeve are attached to each other by means of a sewing seam which is located below the adhesive seam and which is sealed by means of a waterproof sealing tape on its outside facing the outer shaft.

* * * * *